US008874005B2

(12) United States Patent
Tatsuura

(10) Patent No.: US 8,874,005 B2
(45) Date of Patent: Oct. 28, 2014

(54) IMAGE FORMING APPARATUS

(75) Inventor: Satoshi Tatsuura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 176 days.

(21) Appl. No.: 13/442,289

(22) Filed: Apr. 9, 2012

(65) Prior Publication Data

US 2013/0089361 A1 Apr. 11, 2013

(30) Foreign Application Priority Data

Oct. 7, 2011 (JP) ..... 2011-222955

(51) Int. Cl.
*G03G 15/10* (2006.01)
*G03G 15/11* (2006.01)

(52) U.S. Cl.
CPC ..... *G03G 15/11* (2013.01)
USPC ..... 399/237

(58) Field of Classification Search
USPC ..... 399/237
See application file for complete search history.

(56) References Cited

U.S. PATENT DOCUMENTS 6,173,147 B1 * 1/2001 Nakashima et al. ..... 399/308
6,253,051 B1 * 6/2001 Iikura et al. ..... 399/249
7,120,378 B2 * 10/2006 Nomura et al. ..... 399/251
2004/0072091 A1 * 4/2004 Mochizuki et al. ..... 430/108.7
2010/0226687 A1 * 9/2010 Fukazawa ..... 399/240

FOREIGN PATENT DOCUMENTS

JP 11-143243 A 5/1999
JP 2002-287512 A 10/2002
JP 2009-204684 A 9/2009
WO 92/17823 A1 10/1992

OTHER PUBLICATIONS

Machine translation of Takeuchi, JP,2002-287512,A.pdf , publication date: Oct. 3, 2002.*

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

An image forming apparatus includes a developing member that, while rotating, supplies a liquid developer to an image carrier and develops a latent image formed on the image carrier using the liquid developer, a layer-forming device that forms a developer layer, which is a layer formed from the liquid developer, on the developing member, a charging device that charges the developer layer formed on the developing member by the layer-forming device, the charging device being located upstream of the image carrier in a direction of rotation of the developing member, and a heating device that heats the developer layer formed on the developing member by the layer-forming device. The heating device is located upstream of the charging device and downstream of the layer-forming device in the direction of rotation of the developing member.

7 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2011-222955 filed Oct. 7, 2011.

BACKGROUND

Technical Field

The present invention relates to an image forming apparatus.

SUMMARY

According to an aspect of the present invention, an image forming apparatus includes a developing member that, while rotating, supplies a liquid developer to an image carrier and develops a latent image formed on the image carrier using the liquid developer, a layer-forming device that forms a developer layer, which is a layer formed from the liquid developer, on the developing member, a charging device that charges the developer layer formed on the developing member by the layer-forming device, the charging device being located upstream of the image carrier in a direction of rotation of the developing member, and a heating device that heats the developer layer formed on the developing member by the layer-forming device. The heating device is located upstream of the charging device and downstream of the layer-forming device in the direction of rotation of the developing member.

BRIEF DESCRIPTION OF THE DRAWINGS

Exemplary embodiments of the present invention will be described in detail based on the following figures, wherein.

DETAILED DESCRIPTION

Hereinbelow, an exemplary embodiment of the present invention will be described with reference to the drawings.

Overall Structure of Image Forming Apparatus

Firstly, the overall structure of an image forming apparatus will be described.

Figure 1:
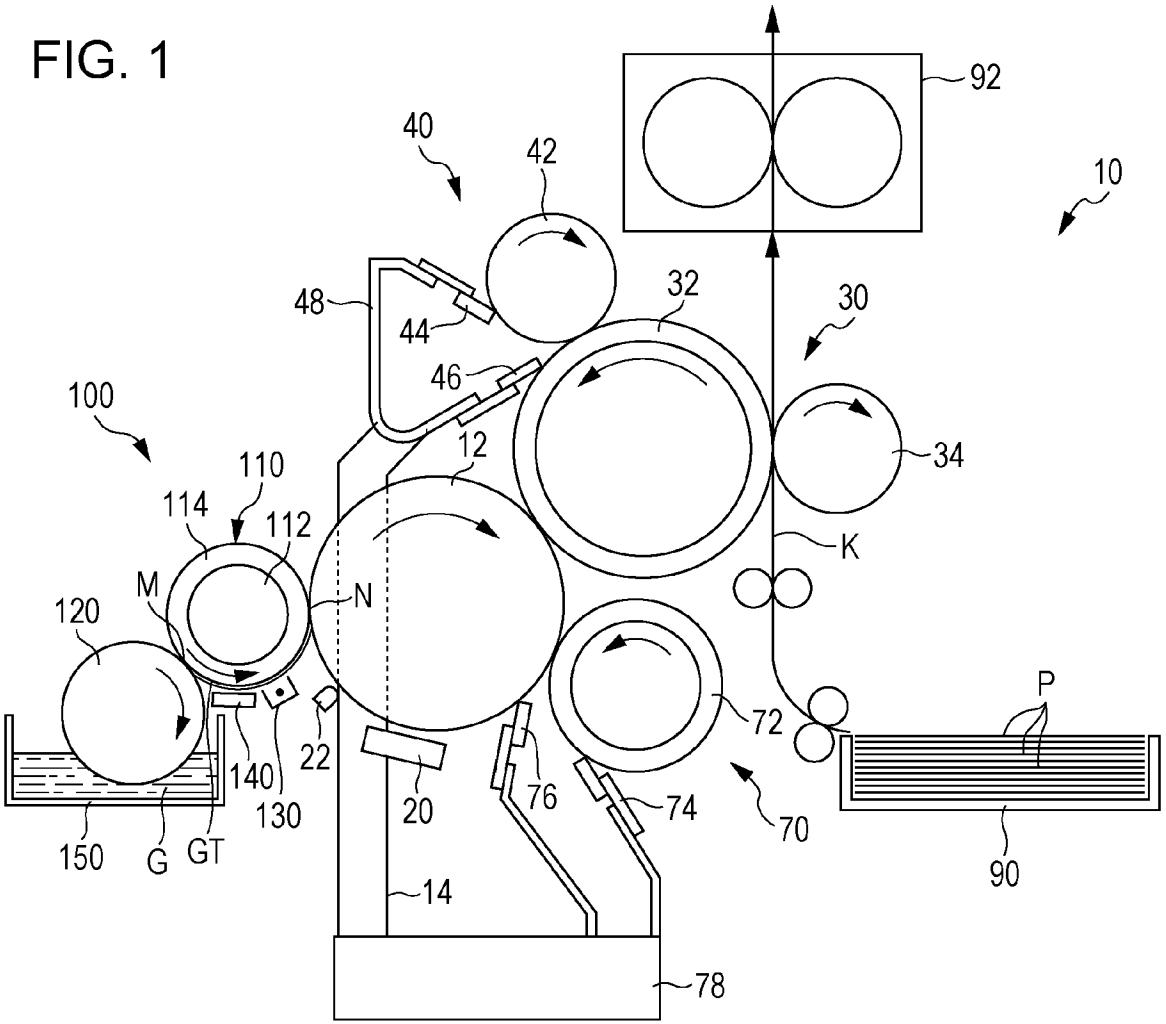
FIG. 1 is a schematic diagram of an image forming apparatus according to an exemplary embodiment of the present invention.

As illustrated in FIG. 1, an image forming apparatus 10 according to an exemplary embodiment of the present invention includes a drum-shaped photoconductor 12 as an example of an image carrier. A charger 20, an exposure device 22, a developing device 100, a transfer device 30, a photoconductor cleaner 70, and the like are arranged around the photoconductor 12.

In this exemplary embodiment, a scorotron charger is adopted as the charger 20, which charges a surface of the photoconductor 12 by corona discharge.

In this exemplary embodiment, an LED exposure device is adopted as the exposure device 22. The exposure device 22 exposes the photoconductor 12, which has been charged by the charger 20, in accordance with image information to form a latent image on the surface of the photoconductor 12. Note that the exposure device 22 may be an exposure device other than an LED exposure device, such as an exposure device that exposes the photoconductor 12 with a laser beam.

The developing device 100 develops (visualizes) the latent image, which has been formed on the photoconductor 12, using a liquid developer G (see FIG. 2) containing a carrier liquid and toner particles distributed in the carrier liquid and thus forms a toner image on the surface of the photoconductor 12. The developing device 100 and the liquid developer G will be described further in detail below.

The transfer device 30 is a device of an intermediate transfer type that includes a drum-shaped intermediate transfer body 32, an intermediate-transfer-body cleaner 40, and a transfer roller 34. A toner image, which has been formed on the surface of the photoconductor 12, is transferred to the intermediate transfer body 32. The transfer roller 34 transfers the toner image, which has been transferred to the surface of the intermediate transfer body 32, to a recording medium P. The transfer device 30 transfers the toner image to the recording medium P using the transfer roller 34 via the intermediate transfer body 32.

The transfer device 30 may have a configuration other than the configuration described above. For example, the transfer device 30 may have a configuration that includes a belt-like intermediate transfer body (see FIG. 6 for example), or a configuration of a direct transfer type that does not include an intermediate transfer body nor an intermediate-transfer-body cleaner and in which the toner image is directly transferred from the photoconductor 12 to the recording medium P using the transfer roller 34.

The photoconductor cleaner 70 includes a first waste-toner tank 78, a cleaning roller 72 that is in contact with the photoconductor 12, and cleaning blades 74 and 76 made of polyurethane rubber. The cleaning blades 74 and 76 are respectively in contact with the cleaning roller 72 and the photoconductor 12 so as to remove the liquid developer G. The removed liquid developer G is recovered in the first waste-toner tank 78.

The intermediate-transfer-body cleaner 40 includes a second waste-toner tank 48, a cleaning roller 42 that is in contact with the intermediate transfer body 32, and cleaning blades 44 and 46 made of polyurethane rubber. The cleaning blades 44 and 46 are respectively in contact with the cleaning roller 42 and the intermediate transfer body 32 so as to remove the liquid developer G. The removed liquid developer G is recovered in the second waste-toner tank 48. The liquid developer G recovered in the second waste-toner tank 48 is transferred to the first waste-toner tank 78 through a duct 14.

In the exemplary embodiment, the intermediate-transfer-body cleaning roller 42 and the photoconductor cleaning roller 72 are each a roller member including a core shaft, such as a stainless steel core shaft, having the surface covered with an oilproof rubber such as acrylonitrile butadiene rubber (NBR) or epichlorohydrin rubber (ECO). The thickness of the rubber layer is in the range of 5 to 20 mm, for example.

The image forming apparatus 10 also includes a container 90 that contains recording media P such as sheets. The recording media P are transported along a transport path K. The image forming apparatus 10 further includes a fixing device 92 that fixes a toner image, which has been transferred to a recording medium P, to the recording medium P. Here, the fixing device 92 may perform contact fusing by using a fixing roller or belt, or non-contact fusing by using an oven, flash lamp, or the like.

Image Forming Process

Now, an image forming process will be described.

Rollers are rotated in the directions indicated by the arrows in the drawings by a driving device, which is not illustrated, or by rotation of other rollers that are rotated by the driving device.

The surface of the photoconductor 12 is charged by the charger 20, and a latent image based on the image information is formed by the exposure device 22. The latent image is developed by the developing device 100, and thus a toner image is formed on the surface of the photoconductor 12. The toner image formed on the photoconductor 12 is first-transferred to the surface of the intermediate transfer body 32 when a bias voltage is applied to a core shaft of the intermediate transfer body 32. The first-transferred toner image is second-transferred to a recording medium P with a bias voltage being applied to the transfer roller 34. The recording medium P having the toner image transferred thereto is transported to the fixing device 92 and the toner image is then fixed to the recording medium P. The recording medium P having the toner image fixed thereto is output to an output portion, which is not illustrated.

Part of a liquid developer G that remains on the photoconductor 12 without being first-transferred to the intermediate transfer body 32 is removed by the photoconductor cleaner 70. Part of the liquid developer G that remains on the intermediate transfer body 32 without being second-transferred to the recording medium P is removed by the intermediate-transfer-body cleaner 40.

When a bias voltage is applied to the core shafts of the intermediate-transfer-body cleaning roller 42 and the photoconductor cleaning roller 72, mainly the toner of the remaining part of the liquid developer G adheres to the cleaning rollers 42 and 72 and is then removed. Thereafter, mainly the carrier liquid of the remaining part of the liquid developer G is removed by the intermediate-transfer-body cleaning blade 46 and the photoconductor cleaning blade 76. With this configuration, toner is effectively prevented from remaining on the intermediate transfer body 32 and the photoconductor 12. Accordingly, image defects such as fogging caused by the remaining toner are effectively prevented from occurring.

Developing Device According to First Exemplary Embodiment

Figure 2:
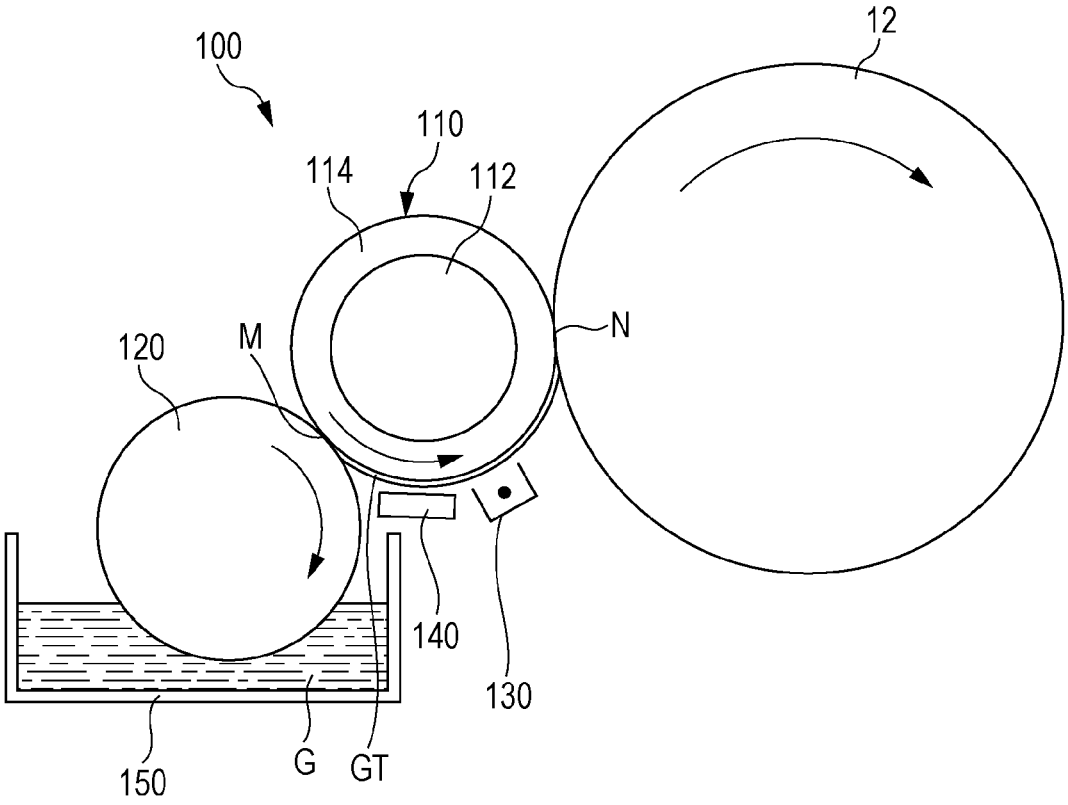
FIG. 2 is a schematic diagram of a developing device according to a first exemplary embodiment of the present invention.

Referring now to FIG. 2, a developing device 100 according to a first exemplary embodiment of the present invention will be described.

As illustrated in FIG. 2, the developing device 100 according to the first exemplary embodiment includes a feeding tank 150, a developing roller 110, and a coating roller (anilox roller) 120.

The feeding tank 150 contains a liquid developer G. The feeding tank 150 includes an agitation screw (not illustrated) that agitates the liquid developer G, a remaining-amount sensor (not illustrated) that detects the remaining amount of the liquid developer, and a concentration sensor (not illustrated) that measures the concentration of the toner in the liquid developer.

When the liquid developer G contained in the feeding tank 150 decreases to an amount requiring replenishment, a replenishing device, which is not illustrated, replenishes the feeding tank 150 with an additional amount of liquid developer G.

The coating roller 120 is disposed such that a lower end portion of the coating roller 120 is soaked in the liquid developer G in the feeding tank 150. Grooves forming an oblique line pattern are engraved on the surface of the coating roller 120. The grooves engraved on the surface of the coating roller 120 may form a pattern other than the oblique line pattern, such as a pyramid pattern or grid pattern. The developing roller 110 is in contact with the coating roller 120.

The developing roller 110 includes a metallic core roller 112 and an elastic layer 114 on the surface of the core roller 112. The elastic layer 114 is semiconductive and has a volume resistivity of $1\times10^{5}$ to $1\times10^{10}$ Ω·cm. A bias voltage is applied to the metallic core roller 112. The coating roller 120 is in contact with the elastic layer 114 of the developing roller 110. At a layer-forming portion M at which the elastic layer 114 of the developing roller 110 is in contact with the coating roller 120, a developer layer GT (the liquid developer G) is formed on the developing roller 110. A development nip portion N (development portion) is formed at a portion at which the elastic layer 114 of the developing roller 110 is in contact with the photoconductor 12. The developer layer GT of the liquid developer G is partly transferred to the surface of the photoconductor 12 at the development nip portion N. A liquid developer GX (not illustrated) that has not been transferred to the surface of the photoconductor 12 remains on the developing roller 110 on a side that is located downstream of the development nip portion N in the rotational direction of the developing roller 110.

A charger 130, which is adopted as an example of a charging device, is disposed between the layer-forming portion M, at which the developing roller 110 is in contact with the coating roller 120 that is disposed at the periphery of the developing roller 110, and the development nip portion N, at which the developing roller 110 is in contact with the photoconductor 12. The charger 130 charges the surface of the developer layer GT between the layer-forming portion M and the development nip portion N. In other words, the charger 130 that is located upstream of the photoconductor 12 in the rotational direction of the developing roller 110 charges the developer layer GT. Here, the charger 130 charges the developer layer GT (liquid developer G) with the polarity that is the same as the polarity of the toner in the developer layer GT. The charger 130 according to the first exemplary embodiment is a corotron charger that performs charging by corona discharge.

A heater 140 is disposed between the layer-forming portion M, which is disposed at the periphery of the developing roller 110, and the charger 130. The heater 140 locally heats the portion of the developer layer GT formed by the layer-forming portion M, the portion being located upstream of the charger 130 in the rotational direction of the developing roller 110, in order to raise the temperature of the developer layer GT. In other words, locally heating the developer layer GT formed by a layer-forming device on the upstream side means that the portion of the developer layer GT located downstream of the charger is not heated, unlike the portion of the developer layer GT located upstream of the charger. The heater 140 according to the exemplary embodiment is an infrared (IR) heater.

In short, the layer-forming portion M, the heater 140, the charger 130, and the development nip portion N are disposed around the developing roller 110 in order from the upstream side in the rotational direction of the developing roller 110.

Liquid Developer

Now, a liquid developer G used in the first exemplary embodiment will be described.

The liquid developer G contains a carrier liquid and toner (particles) that is distributed in the carrier liquid. An insulating liquid, such as a vegetable oil, a fluid paraffin oil, or a silicone oil, is adopted as the carrier liquid. In the first exemplary embodiment, the average particle size of the toner (particles) is 0.5 to 5 μm, and the toner is evenly distributed in the carrier liquid at a concentration of 15 to 35 wt %. In addition, a charge control agent or distribution agent may be appropriately added to the liquid developer G.

The viscosity of the liquid developer G (carrier liquid) decreases as the temperature increases, and increases as the temperature decreases.

Forming Developer Layer from Liquid Developer on Developing Roller and Forming Toner Aggregated Layer Next, how a developer layer GT is formed on the developing roller 110 from the liquid developer G and how a toner aggregated layer is formed will be described. Rollers that are to be referred to are rotated by a driving device, which is not illustrated, in the arrow directions illustrated in the drawings.

Grooves forming an oblique line pattern are engraved on the surface of the coating roller 120. The grooves engraved on the surface of the coating roller 120 are refilled with the liquid developer G contained in the feeding tank 150. The liquid developer G is transferred to the surface of the developing roller 110 at the layer-forming portion M of the developing roller 110, and thus a developer layer (thin film layer) GT is formed on the surface of the developing roller 110.

Subsequently, the developer layer GT is locally heated by the heater 140 and the temperature rises. With the increase in temperature of the developer layer GT (liquid developer G), the viscosity of the developer layer GT (liquid developer G) decreases.

In a state in which the temperature of the developer layer GT (liquid developer G) is high and the viscosity of the developer layer GT is low, the charger 130 charges the surface of the developer layer GT. By charging the surface of the developer layer GT, a potential difference is generated between the surface of the developer layer GT and the surface of the developing roller 110. With an electric field occurring due to the potential difference, the toner (particles) in the developer layer GT (liquid developer G) moves toward the developing roller 110 by electrophoresis, and is then compressed. With the toner moving and being compressed, a layer in which toner is aggregated (toner aggregated layer) is formed on a developing roller 110 side of the developer layer GT, and a carrier liquid layer that contains a negligible amount of toner is formed on the surface side of the developer layer GT.

The developer layer GT having the toner aggregated layer and the carrier liquid layer formed therein moves further toward the development nip portion N. The temperature of the developer layer GT (liquid developer G) decreases while the developer layer GT is moving because the heat of the developer layer GT is removed by the outside air and the developing roller 110 and thus the developer layer GT is cooled down. When the temperature of the developer layer GT (liquid developer G) decreases, the viscosity of the developer layer GT (liquid developer G) increases. While the developer layer GT (liquid developer G) has a low temperature and a high viscosity, a latent image formed on the photoconductor 12 is developed at the development nip portion N.

Developing Device According to Second Exemplary Embodiment

Figure 3:
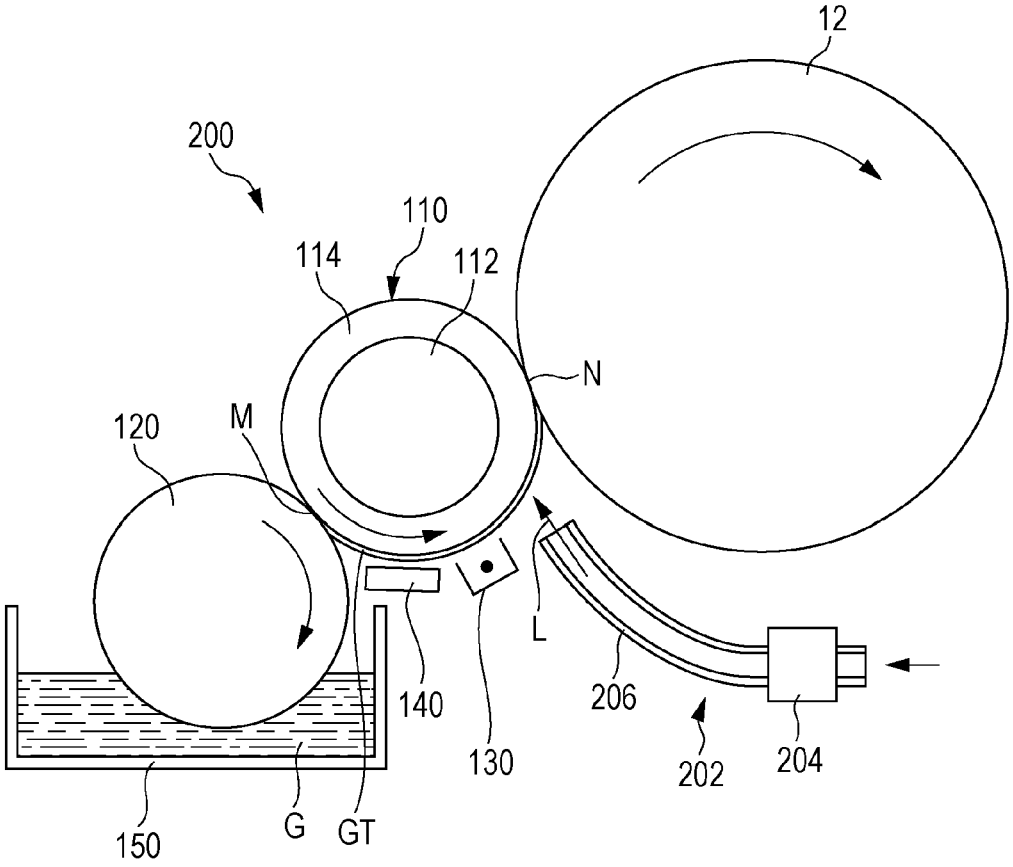
FIG. 3 is a schematic diagram of a developing device according to a second exemplary embodiment of the present invention.

Referring now to FIG. 3, a developing device 200 according to a second exemplary embodiment of the present invention will be described. Components that are the same as those in the developing device according to the first exemplary embodiment are denoted by the same reference signs and redundant description will not be given.

As illustrated in FIG. 3, the developing device 200 according to the second exemplary embodiment includes a cool-air blowing device 202 as an example of a cooling device. The cool-air blowing device 202 blows cooling air L to the developer layer GT between the charger 130 and the development nip portion N. The cool-air blowing device 202 includes a device body 204 that takes in the outside air and cools the air to form cooling air L, and a nozzle 206 that blows the cooling air L to the developer layer GT.

Except for the cool-air blowing device 202, the configuration according to the second exemplary embodiment is the same as that according to the first exemplary embodiment, and thus the description thereof is not given.

Modifications of Second Exemplary Embodiment

Now, modifications of the second exemplary embodiment will be described.

First Modification

Figure 4:
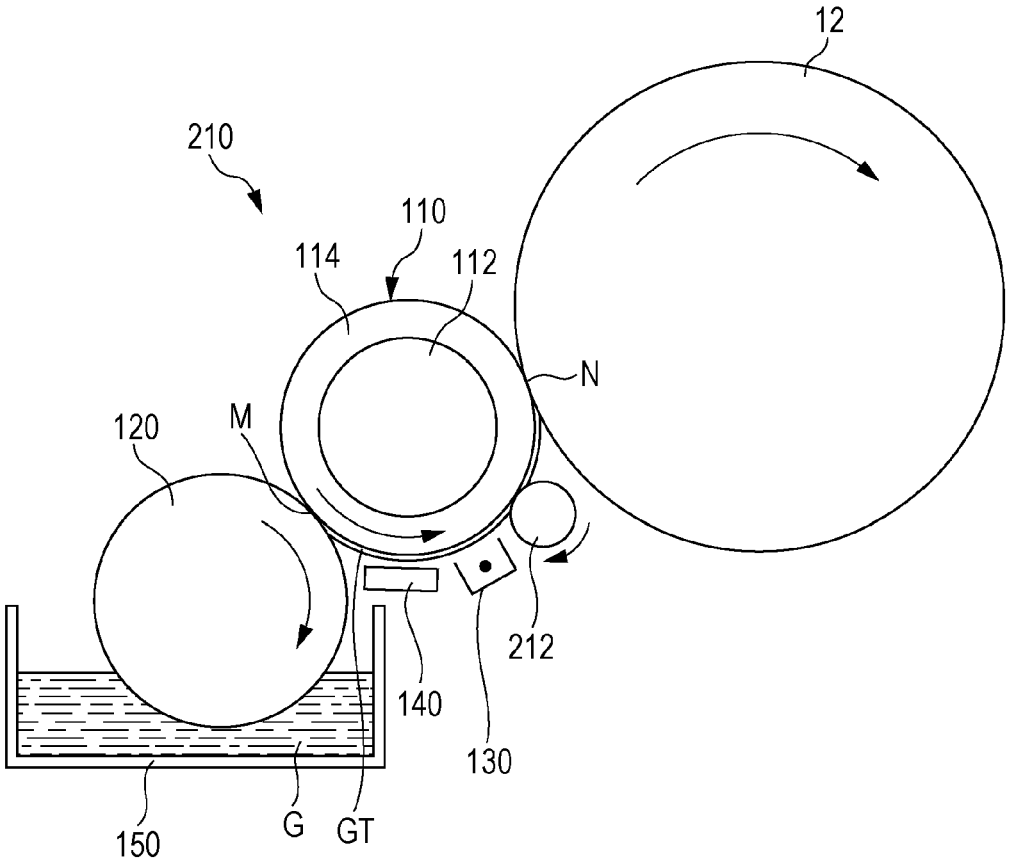
FIG. 4 is a schematic diagram of a developing device according to a first modification of the second exemplary embodiment of the present invention.

Referring now to FIG. 4, a developing device 210 according to a first modification will be described.

The developing device 210 according to the first modification illustrated in FIG. 4 includes a cooling roller 212 as an example of a cooling device. The cooling roller 212 is made of metal, and disposed so as to be spaced apart from or in contact with the developing roller 110. The cooling roller 212 is rotated at the same rate in the same direction as those of the developing roller 110 by a driving mechanism, which is not illustrated, at a portion at which the cooling roller 212 faces the developing roller 110.

Further, a bias voltage is applied to the cooling roller 212. The bias voltage is polarized such that the toner moves to the developing roller 110 side (the bias voltage has the same polarity as the charger 130).

In this modification, the cooling roller 212 is in direct contact with the developer layer GT and removes the heat to cool the developer layer GT. Thus, the developer layer GT (liquid developer G) is efficiently cooled down. Here, a radiating device that radiates the heat of the cooling roller 212 may be provided.

Since a bias voltage is applied to the cooling roller 212, the toner does not adhere to the cooling roller 212. In addition, the application of the bias voltage to the cooling roller 212 brings about an effect of forming a toner aggregated layer in which the toner is further aggregated.

Second Modification

Figure 5A:
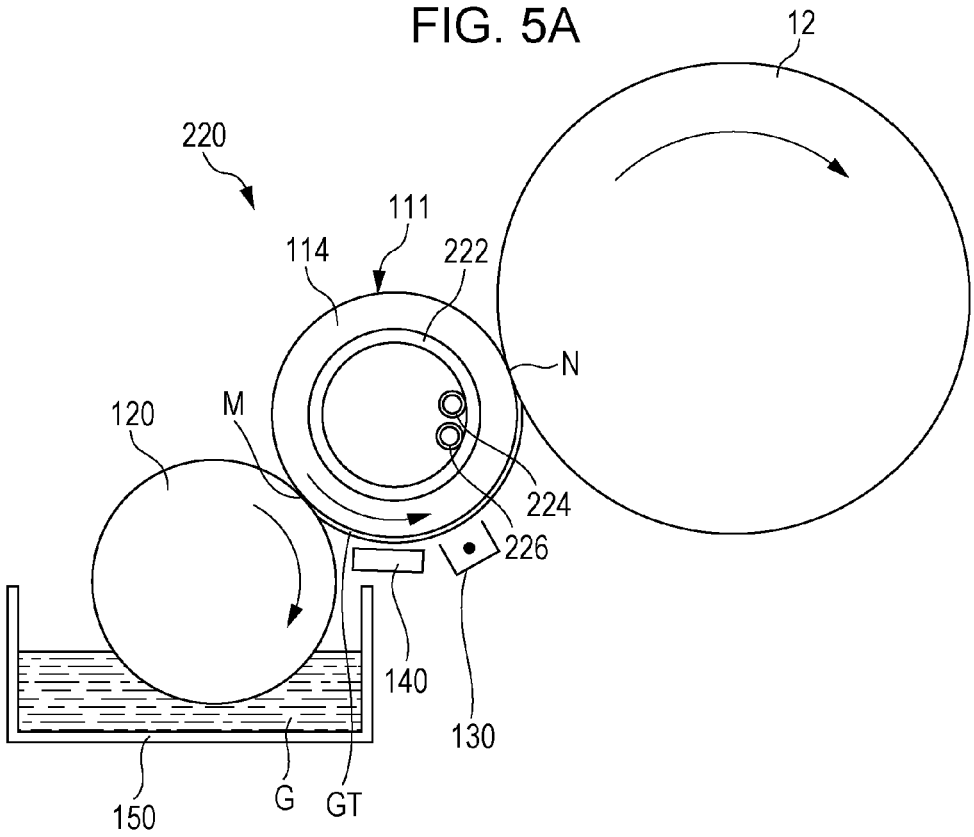
FIG. 5A is a schematic diagram of a developing device according to a second modification of the second exemplary embodiment of the present invention.
Figure 5B:
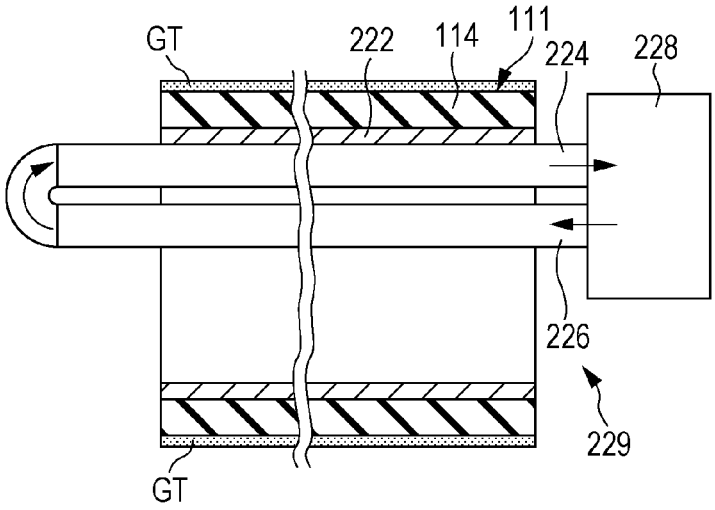
FIG. 5B is a schematic diagram of a configuration of a coolant circulation device taken in an axial direction of a developing roller.

Referring now to FIGS. 5A and 5B, a developing device 220 according to a second modification will be described.

The developing device 220 according to the second modification illustrated in FIGS. 5A and 5B includes a coolant circulation device 229, which is an example of a cooling device and illustrated in FIG. 5B. The coolant circulation device 229 includes a device body 228 and two metal pipes 224 and 226. The device body 223 takes in a coolant (water in this modification), cools the coolant, and ejects the coolant. The two metal pipes 224 and 226 allow the coolant cooled by the device body 228 to circulate therethrough.

As illustrated in FIGS. 5A and 5B, a metal core roller 222 of the developing roller 111 is a pipe (cylindrical) in this modification. The two pipes 224 and 226 are disposed along the axis such that the pipes 224 and 226 are in contact with and slide over an inner peripheral surface of the core roller 222 at a portion between the charger 130 and the development nip portion N.

The coolant circulating through the pipes 224 and 226 locally cools the developing roller 111, and thus the developer layer GT is cooled down. Since the pipes 224 and 226 are in contact with the inner peripheral surface of the core roller 222 of the developing roller 111 to cool the developing roller 111, the developer layer GT (liquid developer G) that is formed on the developing roller 111 (that is in contact with the developing roller 111) is efficiently cooled down.

Here, the pipe 224 may be disposed so as to be in contact with the inner peripheral surface of the core roller 222 at a portion that faces the development nip portion N to further efficiently cool the liquid developer G at the development nip portion N and to thus reduce the viscosity.

Developing Device According to Third Exemplary Embodiment

Figure 6:
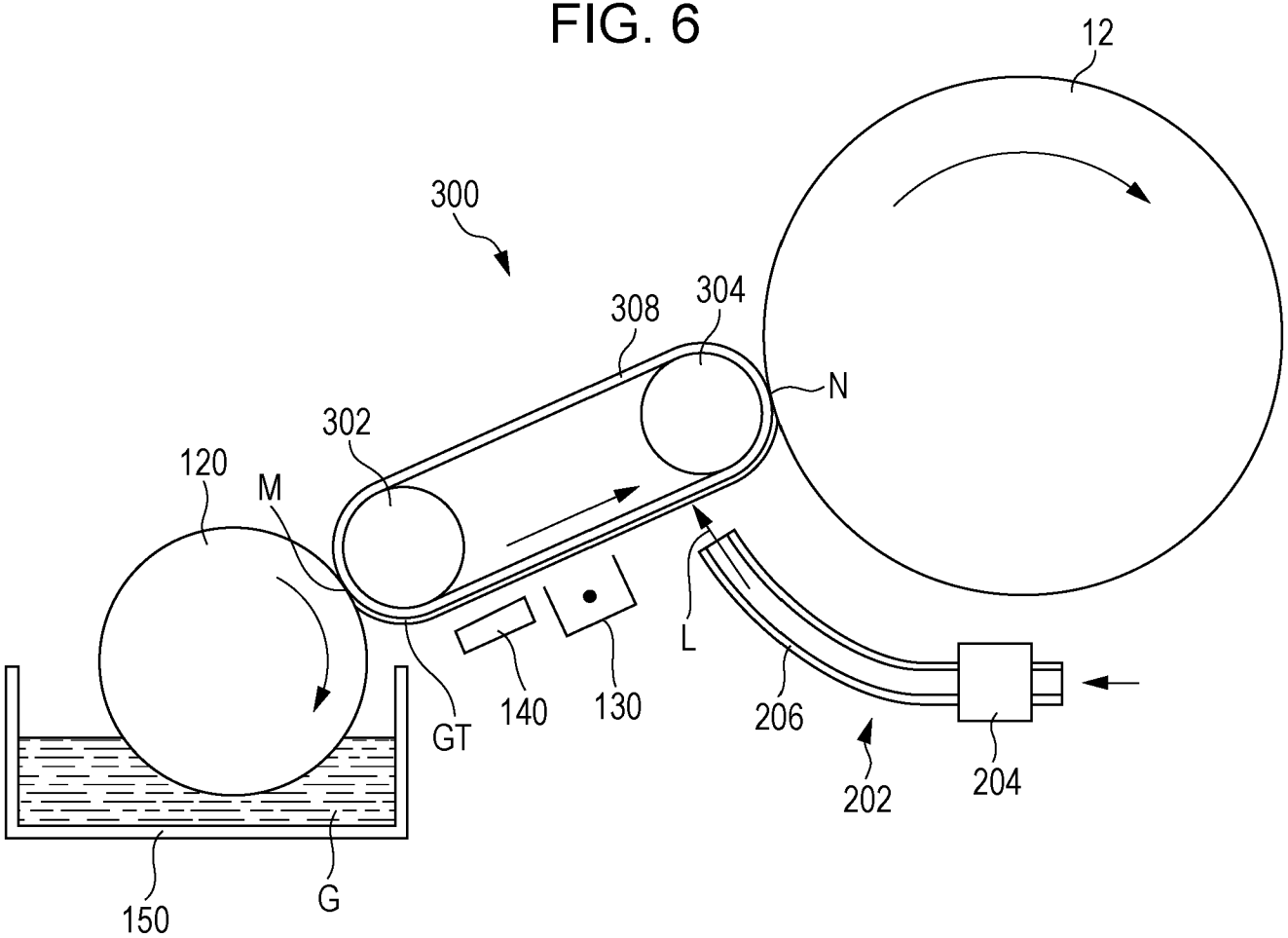
FIG. 6 is a schematic diagram of a developing device according to a third exemplary embodiment of the present invention.

Referring now to FIG. 6, a developing device 300 according to a third exemplary embodiment of the present invention will be described. Components that are the same as those in the first and second exemplary embodiments are denoted by the same reference signs, and redundant description will not be given.

As illustrated in FIG. 6, the developing device 300 according to the third exemplary embodiment includes a driving roller 302 that is rotated by a driving device, which is not illustrated, a tension roller 304, and a development belt 308 that is stretched between the driving roller 302 and the tension roller 304. The development belt 308 is made of the same material as that of the elastic layer 114 (see FIG. 2) of the developing roller 110 according to the first exemplary embodiment. A bias voltage is applied to each of the driving roller 302 and the tension roller 304, which are made of metal.

The grooves engraved on the surface of the coating roller 120 are refilled with the liquid developer G contained in the feeding tank 150, and the liquid developer G is transferred to the development belt 308 at the layer-forming portion M. Thus, a developer layer GT of the liquid developer G is formed on the surface of the development belt 308. Then, a latent image formed on the photoconductor 12 is developed at the development nip portion N.

A charger 130 is disposed between the layer-forming portion M, at which the development belt 308 is in contact with the coating roller 120, and the development nip portion N, at which the development belt 308 is in contact with the photoconductor 12. The charger 130 charges the surface of the developer layer GT between the layer-forming portion M and the development nip portion N.

The developing device 300 also includes a cool-air blowing device 202 that blows cooling air L to the developer layer GT between the charger 130 and the development nip portion N (the cool-air blowing device 202 here is the same as the cool-air blowing device 202 illustrated in FIG. 3).

Other Exemplary Embodiments

The present invention is not limited to the exemplary embodiments described above.

For example, multiple cooling devices may be installed together. For example, two cooling devices, such as a cool-air blowing device 212 (see FIGS. 3 and 6) and a coolant circulation device 229 (see FIG. 5) may be installed. A coolant circulation device 229 and a cooling roller 212 may be disposed if a space is secured for disposing these. Securing a space for disposing these is easier in the configuration of the development belt 308 (see FIG. 6) according to the third exemplary embodiment than in the configuration of the developing roller 110 (see FIG. 2).

Furthermore, a device other than the heater 140 may be adopted as a heating device. For example, a cool-air blowing device, which is used for cooling the developer layer GT, may blow a hot air (a hot-air blowing device). Alternatively, a cooling roller may be used after being heated (a heating roller). Instead, a coolant circulation device may allow a hot liquid to flow through a pipe therein (a hot liquid device).

In the above exemplary embodiments, a coating roller (anilox roller) 120 is adopted as an example of a layer-forming device, which forms a developer layer GT, in a developing member (the developing rollers 110 and 111 and the development belt 308). However, the present invention is not limited thereto. A developer layer GT may be formed by a device other than a developing member (the developing rollers 110 and 111 and the development belt 308). For example, a coating device that coats a liquid developer, such as a slot die head, may be adopted to form a developer layer GT on the developing member (the developing rollers 110 and 111 and the development belt 308).

In the above exemplary embodiments, a corotron charger is adopted as the charger 130, which is an example of a charging device, but the present invention is not limited thereto. The charging device may be other than a corotron charger. For example, the charging device may be a scorotron charger. Instead, a publicly known charger (charging device), such as a needle electrode or a pin array charger, may be adopted.

When a liquid developer that has a high viscosity at normal temperature is used to improve the adherence of the liquid developer, it may be difficult to form a developer layer GT since the liquid developer has a low fluidity. In such a case, the temperature of the liquid developer in the feeding tank 150 may be raised (the liquid developer may be preheated) so that the liquid developer has such a viscosity that a developer layer is easily formed.

In the above exemplary embodiments and modifications, an image is formed on a recording medium P with a liquid developer G of a single color. However, the present invention is not limited thereto. An image may be formed on a recording medium P with liquid developers G of multiple colors. For example, an image forming apparatus may be adopted that has a configuration in which multiple developing devices according to any of the exemplary embodiments and modifications are arranged.

Further, it is needless to say that the present invention may be embodied by various modes within a scope not departing from the gist of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

a developing member that, while rotating, supplies a liquid developer to an image carrier and develops a latent image formed on the image carrier using the liquid developer;

a layer-forming device that forms a developer layer, which is a layer formed from the liquid developer, on the developing member;

a charging device that charges the developer layer formed on the developing member by the layer-forming device, the charging device being located upstream of the image carrier in a direction of rotation of the developing member; and a heating device that locally heats the developer layer formed on the developing member by the layer-forming device, wherein the heating device is located upstream of the charging device and downstream of the layer-forming device in the direction of rotation of the developing member.

2. The image forming apparatus according to claim 1, further comprising:

a cooling device that cools the developer layer on the developing member, wherein the cooling device cools a portion of the developer layer that is located upstream of the image carrier and downstream of the charging device in the direction of rotation of the developing member.

3. The image forming apparatus according to claim 1, wherein the developing member is a belt that is stretched between a plurality of rollers.

4. The image forming apparatus according to claim 2, wherein the developing member is a belt that is stretched between a plurality of rollers.

5. The image forming apparatus according to claim 2, wherein the cooling device contacts the developer layer and a voltage is applied to the cooling device.

6. The image forming apparatus according to claim 2, wherein the developing member is a hollow developing roller, and wherein the cooling device is disposed inside the developing roller.

7. The image forming apparatus according to claim 1, wherein the heating device is located outside of the developing member and the layer-forming device.

* * * * *